United States Patent [19]

Kunkel et al.

[11] 4,420,510

[45] Dec. 13, 1983

[54] METHOD FOR APPLYING A FOAMED ADHESIVE UNDER START-STOP CONDITIONS

[75] Inventors: Arden L. Kunkel, Tacoma; Darrell E. Pierson, Federal Way, both of Wash.

[73] Assignee: Weyerhaeuser Company, Tacoma, Wash.

[21] Appl. No.: 360,852

[22] Filed: Mar. 23, 1982

[51] Int. Cl.[3] ..... B05D 5/10

[52] U.S. Cl. ..... 427/208.2; 118/702; 118/703; 118/704; 427/244; 427/286

[58] Field of Search ..... 427/244, 286, 208.2; 118/674, 677, 684, 696, 699–704

[56] References Cited

U.S. PATENT DOCUMENTS

| | | | |
|---|---|---|---|
| 2,695,246 | 11/1954 | Jurgensen, Jr. et al. . | |
| 2,734,224 | 2/1956 | Winstead . | |
| 3,081,069 | 3/1963 | Oakes . | |
| 3,381,336 | 5/1968 | Wells . | |
| 3,895,984 | 7/1975 | Cone et al. | 156/79 |
| 3,905,329 | 9/1975 | Cone et al. | 118/411 X |
| 3,905,921 | 9/1975 | Cone et al. | 156/78 X |
| 3,965,860 | 6/1976 | Cone et al. | 118/315 X |
| 4,258,088 | 3/1981 | Cone et al. | 427/316 |

OTHER PUBLICATIONS

Ziegler, J. L., *Mechanized Foaming of Adhesives,* Forest Products Journal, 9: pp. 233–235, Jul. 1959.

Cone, C. N., *Foam Extrusion–A New Way of Applying Glue, Forest Products Journal, 19(11): pp. 14–16, Nov. 1969.*

*Primary Examiner*—Evan K. Lawrence

*Attorney, Agent, or Firm*—Weyerhaeuser Company

[57] ABSTRACT

A method of uniformly applying a foamed adhesive to a normally moving substrate which is subject to stops and starts at irregular intervals. A uniform spread weight of adhesive is applied during a deceleration period and startups can be accomplished without causing puddles or gaps. The method is especially useful in conjunction with an automated plywood lay-up line. Foamed adhesive is supplied under pressure to an extrusion head. When a line stoppage is sensed a first valve above the extrusion head closes. Adhesive within the head continues to expand and fall onto the substrate, but does so at a descreasing rate during the deceleration time. As the substrate comes to a complete stop a second valve prevents further adhesive from being applied. Before a startup, the adhesive in the system is reconditioned by passing it into a recycle line until foam quality andpressure drop across the extrusion head have again assumed normal operating parameters. Only then is the substrate movement started. At that time application of adhesive is resumed.

23 Claims, 14 Drawing Figures

LINE RUNNING

LINE STOPPED

METHOD FOR APPLYING A FOAMED ADHESIVE UNDER START-STOP CONDITIONS

BACKGROUND OF THE INVENTION

The present invention is a method of uniformly applying a foamed adhesive to a moving substrate which is subject to starts and stops at irregular intervals.

Foamed adhesives have been investigated for the preparation of various types of laminates such as plywood and corrugated board. The use of a foamed adhesive is said to convey a number of advantages. A principal claim has been reduced adhesive usage. One reason for this is believed to be decreased penetration of the adhesive into the substrate material. In plywood manufacture, claims have also been made for shorter press times when a foamed adhesive is used.

Foamed adhesives in themselves are not new. Their preparation and use can be exemplified in the following United States Patents to Cone and Steinberg; U.S. Nat. Nos. 3,895,984, 3,905,329, 3,905,921, 3,965,860 and 4,258,088. Their practicality for plywood manufacture came about with the advent of continuous lay-up lines about 1960. These lines are subject to frequent and unpredictable stops which may be from a few seconds to a half-hour or more in duration. It was not too difficult to engineer a system for making and applying a foamed glue which would work satisfactorily on a continuously running lay-up line. However, the stops and starts have presented a problem which has not been satisfactorily overcome until the time of the present invention. The major problem to be overcome is that of over application or under application of adhesive to the veneer between the time when a signal is given to stop the line until the line is once again operating at full speed.

The conveyor lines which carry the veneers are massive in size and have considerable inertia to overcome in a start-stop cycle. As a result, when a stop signal is given, the line may travel as much as two meters before it comes to a complete stop. During this time period the line speed is continuously decreasing. Therefore, if adhesive is applied at a constant rate per unit of time the veneer will be overspread during the decleration period. The usual result of overspreading in plywood manufacture is a poor bond because the thermosetting adhesive in the overspread area will be undercured. Frequently, a "blow" will result. This is a circumstance where a steam pocket forms between the veneers due to the excessive moisture in the overspread area. The result is a partially delaminated product which is either unsalable or must be seriously downgraded in value.

In an attempt to control overspreading, the results have often been at the opposite extreme. In this case, a portion of veneer is underspread or no adhesive at all is applied during all, or a portion, of the start-stop cycle. The ultimate result is the same and the product contains delaminations which render it generally unsalable.

Cone et al. in U.S. Pat. No. 3,905,329 describe a system in which foamed glue is applied to wood veneer through an extrusion head containing a plurality of orifices. When a sensor detects that the veneer has stopped its movement, an electrically operated valve redirects the foamed adhesive away from the extrusion head and into a defoaming device. The defoamed glue is recycled into a holding tank where it is mixed with fresh adhesive entering the tank. The system continues to operate with foamed glue being recycled until the sensor detects that the assembly line is once again moving. This patent does not indicate that any provision has been made for keeping glue spread uniform in the decleration period prior to a complete stop, and the acceleration period during a start-up.

Spread uniformity across a substrate of some width is another problem that has bothered foamed adhesive systems. Cone and Steinberg, in U.S. Pat. No. 3,895,984 show several manifold constructions which are designed to achieve uniform flow from each orifice in the manifold. They also show one construction in which adhesive flow to the substrate can be stopped through the action of a slide valve located immediately above the orifces or extrusion nozzles in the manifold. The sequence of events during a start-up or shut down are similar to those described in U.S. Pat. No. 3,905,329, except that a second valve, acting in concert with the slide valve, serves to divert the flow of foamed adhesive back through the defoamer.

Other inventors have taken a different track to the achievement of uniform flow to a plurality of nozzles mounted on a manifold. Winstead in U.S. Pat. No. 2,734,224 and Wells in U.S. Pat. No. 3,381,336 have employed a channel system which repeatedly bifurcates until each nozzle is individually fed from its own channel. As each larger channel divides into smaller ones, the cross-sectional area is reduced so that the sum of the area of the smaller channels is approximately equal to the area of the larger channel. Additionally, any given point downstream from a bifurcation is equidistant from the point at which the division occurs.

Foaming devices themselves are well known in the art. Examples might be those described in the patents to Jurgensen, Jr., U.S. Pat. No. 2,695,246 and Oakes, U.S. Pat. No. 3,081,069. The former device was designed specifically to be useful in the preparation to foamed rubbers while the latter is useful in a very wide variety of foamed products. It has found considerable use within the food industry. Unfortunately, no satisfactory system is found in the prior art to deal with the problem of uneven longitudinal adhesive application to a substrate which is subject to irregular starts and stops.

SUMMARY OF THE INVENTION

The present invention comprises a process for applying a essentially uniform amount of a foamed adhesive to a substrate which is normally moving at a uniform rate of speed but which is subject to starts and stops at irregular intervals. This method is specifically designed to apply a decreasing amount of adhesive during the period of deceleration during a line stoppage so that spread weight on the substrate is held essentially constant. A method is further provided by which adhesive can be applied to the substrate during start-ups so that puddles or gaps are not formed. The overall result is a substrate which has a continuous and essentially uniform deposit of adhesive regardless of the fact that adhesive was being applied at a time when a stop and start-up had occured.

These results are accomplished by providing an extrusion head adjacent to the moving substrate material with means to deposit a predetermined amount of the foamed adhesive from the head onto the moving substrate. When a signal is sent to stop the conveyor line carrying the substrate, a parallel signal simultaneously closes a first valve located in the near proximity of the extrusion head in order to cut off the supply of foamed adhesive to the head. The valve is located in the adhesive supply line and the line and head are sized to define a predetermined volume of foamed adhesive which remains in the system under residual pressure. Residual adhesive in the head is allowed to flow onto the decelerating substrate material from the action of the retained pressure. The pressure continually drops as the retained volume flows from the extrusion nozzles. Flow rate also decreases as the pressure drops so that by properly sizing the system the spread rate remains essentially constant during the declaration period. At approximately the time when the substrate has decelerated to a complete stop, a second valve, such as a three-way valve, is closed. This is located at a point in the extrusion system where the foamed adhesive is at essentially atmospheric pressure. Closing this valve stops any further flow of adhesive onto the substrate. During the time period when the substrate is stopped, no more adhesive is applied. Preferably, any adhesive remaining under pressure in the extrusion head at the time the second valve is closed is diverted into a recycle line. Here it can be directed into a defoamer from whence it is returned to an adhesive holding tank. The second valve is preferably a slide valve located immediately above the extrusion nozzles. This valve can be constructed so as to automatically divert any flow of adhesive from the nozzles to the recycle line.

One of the prior art deficiencies has been caused by the continuous recycling of adhesive to the holding tank during line stoppages. The continuous action of foaming and defoaming during these stoppage periods adversely affects the adhesive characteristics. A change in rheology and specific gravity is often noted and it has been found to be very difficult to maintain uniformity of spread rate without almost continuously adjusting the flow rate of adhesive in the system. One way the present invention accomodates this problem is by reducing the amount of adhesive recycled to a minimum. During the shut down process, after the first valve controlling the flow of adhesive to the extrusion head has been closed, the pumps supplying adhesive to the system are allowed to continue to run until the line pressure in the adhesive line, measured at the first valve, has risen to the normal discharge pressure of the pumps. At this time, the pumps are shut down and the pumps and valving maintain the pressure within the adhesive supply line until the system is again called upon to deliver adhesive. By maintaining the foamed adhesive supply line under pressure during line stoppages, the startup time is significantly reduced, as is the amount of adhesive that must be recycled on startup. To this point in the operation, the only adhesive that is recycled has been the minor amount retained within the head which was not permitted to fall upon the substrate after the second valve was closed.

The next step in the process begins when a signal is sent directing the conveyor line carrying the substrate to again start. Foamed adhesive will slowly deteriorate in quality as it is held under pressure within the system. Since line stoppages can vary from a few seconds to as long as a half hour or even greater, it is essential that the foamed adhesive delivered to the substrate be of consistent quality. In order to accomplish this purpose, on start-up the foamer is again started. Then the first valve, located adjacent to the extrusion head, is opened to permit a supply of foamed adhesive to flow into the extrusion head. When the pressure at the first valve has fallen to a predetermined value, the adhesive and foam supply pumps are started. The second valve, located at or near the extrusion nozzles, is not yet opened. Instead, the first adhesive which enters the extrusion head after a shut down period is temporarily diverted into the recycle line. After an appropriate short time period, sufficient to establish a predetermined foam quality and pressure drop across the extrusion head, the conveyor line is again started to begin forward movement of the substrate. At a very brief time interval later, the second valve located adjacent to the nozzles is opened to again permit adhesive to flow onto the substrate.

The preferred composition of foamed adhesive for use with the present method should have a cohesive quality, but it will not normally have the rheological properties of a liquid. It should possess sufficient cohesive strength so that the beads of foam extruded from the nozzle will retain their integrity and not drip or flow from the nozzle when the substrate movement is stopped. They should remain as discreet strands depending from the orfices until they meet the underlying substrate material. By starting the substrate a brief period of time before adhesive flow is resumed, these depending strands are pulled or stretched from the nozzles so that they continue to fall on the substrate as the flow of foamed adhesive is resumed. In this manner, no breaks occur in the strands of foam applied to the substrate material.

It is an object of the present invention to provide a method whereby a foamed adhesive may be uniformly applied to a normally moving substrate during periods in which it must be stopped and restarted.

It is a further object to provide a method for applying a foamed adhesive to a substrate material which eliminates the need for recycling large amounts of adhesive during substrate stoppage periods.

It is another object to provide a method for applying foamed adhesive to a substrate that eliminates puddles or gaps in the adhesive during periods of interruption in the substrate movement.

It is yet another object of the present invention to provide a method of applying a foamed adhesive to a continuously moving substrate in which adhesive quality is maintained more nearly constant by minimizing recycle, thus reducing or eliminating problems in spread rate control.

These and many other objects will become clear and apparent to one skilled in the art upon reading the following detailed description with reference to the accompanying drawings.

DESCRIPTION OF THE PREFERRED EMBODIMENTS

The following description relates to the use of a foamed adhesive application system on a continuous plywood layup line. It will be apparent to those skilled in the art that the system will have many other uses; e.g., in the general field of lamination. It will also be apparent that many equivalents to the mechanical equipment and process steps could be used to achieve similar functions and results. Therefore, the invention should not be considered as limited to those particular embodiments which are herein disclosed.

Figure 1A:
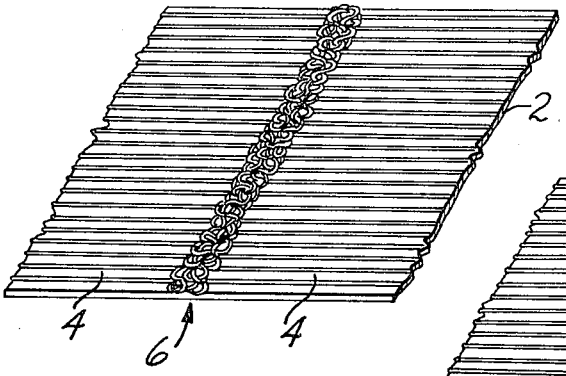
Fig. 1A PRIOR ART
FIG. 1 is a perspective view showing the common deficiencies in the prior art of overspread and adhesive gaps that are caused by line stoppage and starting.
Figure 1B:
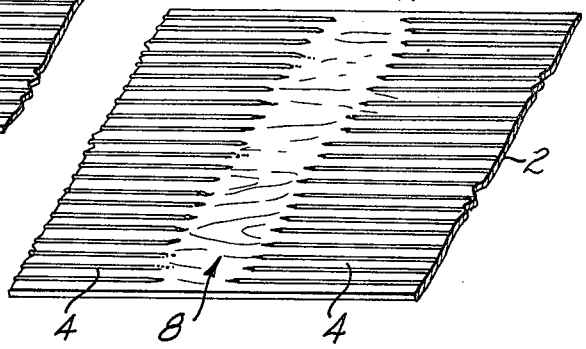
Fig. 1B PRIOR ART

One of the common problems experienced in the prior art when extruding a foamed adhesive onto plywood veneers has been over-spreading when it was necessary to stop a layup line. This problem is indicated in FIG. 1A. The veneer 2 has been coated with parallel beads of adhesive 4. During a stoppage period, when the veneer decelerated to a stop, an excessive amount of adhesive was allowed to accumulate because the flow rate of adhesive was not adjusted relative to the decreasing speed of the veneer. This situation is indicated by an area 6 in which the adhesive has accumulated as a puddle or zone similar in appearance to a group of soft spaghetti strands which have been dropped at random on top of each other. On start-up, depending on when and how adhesive flow to the veneer was resumed, additional adhesive could be contributed to the already accumulated puddle. The opposite situation very often occurred as a result of attempting to overcome the foregoing problem. This is shown in FIG. 1B. In this case, adhesive to the extrusion head was cut off too soon, resulting in a gap 8 on the veneer in which no adhesive was present. In the first case, the probable result would be a piece of plywood having an area in which the adhesive was poorly cured or which a blow occurred. In the second case, the veneers would be completely unbonded.

Figure 2:
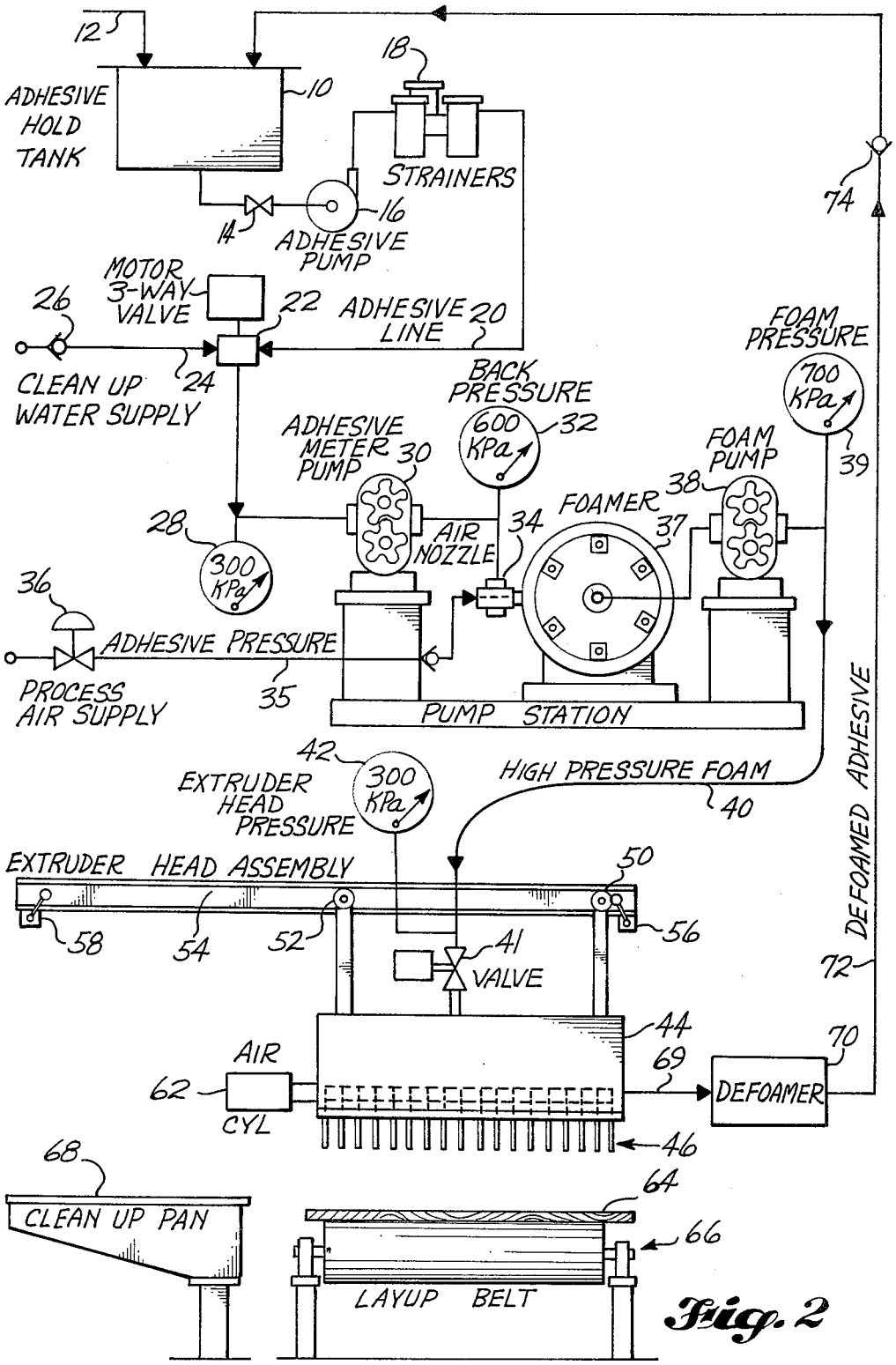
FIG. 2 is a diagrammatic representation of the equipment and adhesive flow patterns of the present invention.

The equipment for carrying out the present process can be readily visualized by reference to FIG. 2. A hold tank 10 receives a formulated adhesive 12 from a mixing tank. In the present process, the adhesive is normally made from a thermosetting phenolic resin containing dried animal blood as a foaming agent. Adhesives of this type are described in U.S. Pat. No. 3,905,921 to Cone et al. The adhesive is drawn from the tank through a valve 14 and pump 16 where it is directed through strainers 18 into an adhesive supply line 20. The adhesive supply line 20 is further directed through a threeway valve 22 to an adhesive metering pump 30. Also entering the three-way valve is a water line 24 containing a check valve 26. This water line supplies water for clean up of the system when this is necessary during prolonged shutdown periods. A pressure sensor/indicator 28 is located near the suction side of the adhesive-metering pump 30. The metering pump is preferably a positive displacement type, such as a gear pump. Another pressure sensor/indicator 32 is located near the output of the adhesive metering pump. Adhesive from this pump is directed to a nozzle 34 where it is combined with compressed air supplied through line 35 and pressure regulator 36. The nozzle is at the inlet side of a foamer 37.

Figure 3:
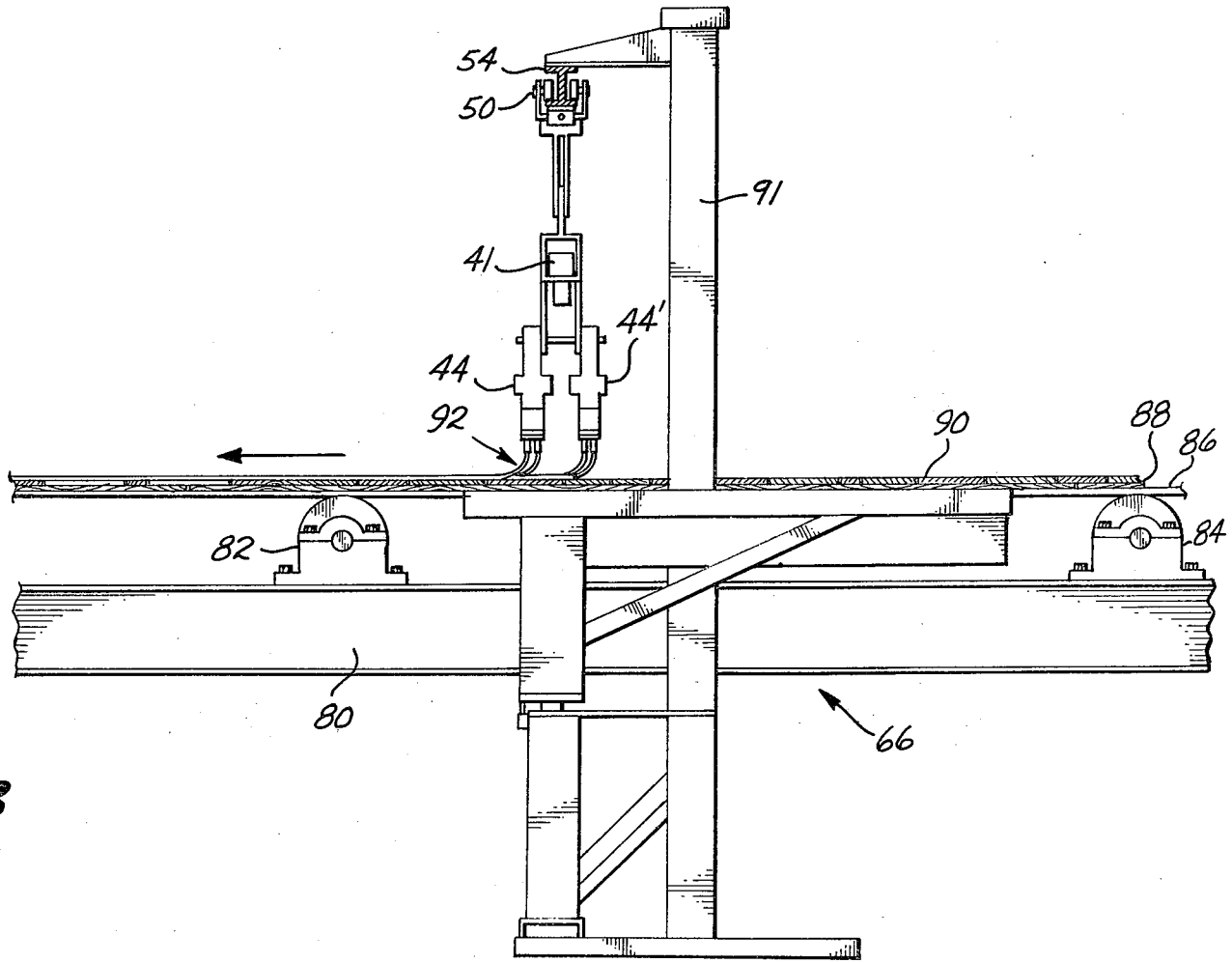
FIG. 3 is a left side elevation of the adhesive extrusion heads in operating position on a plywood lay-up line.
Figure 5:
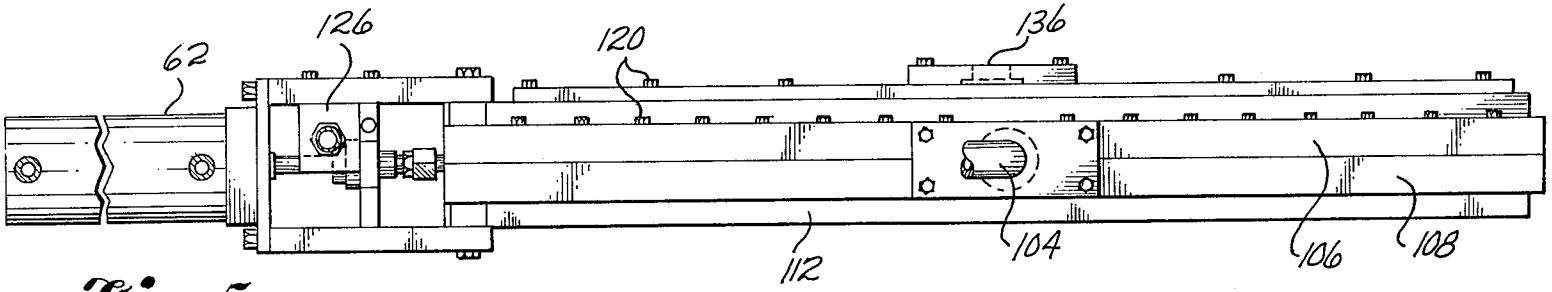
FIG. 5 is a top plan view of an extrusion head.
Figure 4:
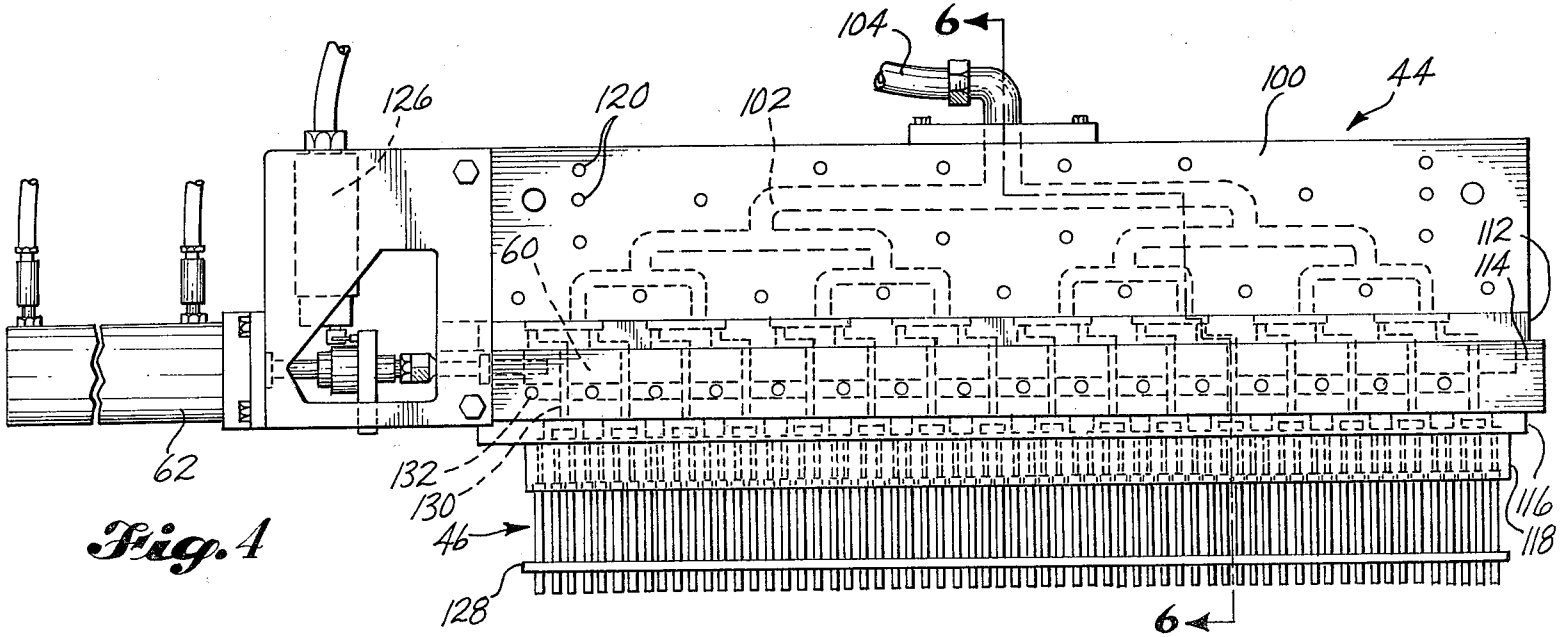
FIG. 4 is a front elevation of an extrusion head showing in particular the internal channeling.

One of the novel features of the present system is the use of foam pump 38 to supply back pressure on the foaming system and to insure uniform delivery of foam to the extrusion head. This pump also functions to enable much more precise control of the amount of air introduced into the foam than does control of air pressure alone. It has surprisingly been found that this pump may also be a gear pump. Normally, one skilled in the art would expect that the high shear forces found in a pump of this type would tend to break down the foam. This has not been found to be the case as long as the pressure differential across the foam pump does not exceed approximately 200 kPa. Another pressure sensor/indicator 39 is located at or near the output of the foam pump. From pump 38, the foam is directed through a high-pressure foam ine 40 to a first valve 41 located closely adjacent to the extrusion head. A fourth pressure sensor/indicator 42 is located at this point. Adhesive spreading is accomplished by the use of extrusion head 44 which contains uniformly spaced extrusion nozzles 46. In a normal veneer layup operation on veneer which is approximately 127 cm (50 in) wide it may be preferred to use shorter heads 44, 44' end-to-end to insure uniform flow from nozzle to nozzle (FIG. 3).

The extrusion head or heads are mounted on rollers 50, 52 which ride on a track 54 so that the head can be moved out of operating position over the line for clean up. A limit switch 56 determines when the head is in position for operation, and a second limit switch 58 shows when the head has been properly removed for cleanup.

The head itself contains a second valve which in this case is a slide valve 60. While other types of valves could be used to accomplish the same purpose, the slide valve appears to be an efficient way of shunting adhesive between the application nozzles and the recycle line. The slide valve is actuated by a pneumatic cylinder 62.

As shown n the diagrammatic representation of FIG. 2, the extrusion head is mounted in position to deliver adhesive to wood veneers 64 being conveyed on a power-driven conveyor line, generally indicated as 66. A clean-up tray 68 is located immediately beside the layup line. During longer shut-down periods, the extrusion head can be rolled out over this tray for flushing. The three-way valve 22 is then energized and water is flushed through the system to clean out residual adhesive. Since only a small amount of water is needed to accomplish efficient clean up, the mixture of water and adhesive can be returned to the adhesive make-up station where it is recycled rather than discharged as an undesirable component into the environment.

When line shut-downs are temporary in duration, the extrusion head is allowed to remain in position over the layup belt. In this case the slide valve 60 is activated and, as will be described in more detail later, any residual foam in the system is directed through line 69 to a defoamer 70, through return line 72 and check valve 74, back into the adhesive hold tank 10. The defoamer may be any of several known types, such as the one shown in Cone et al. U.S. Pat. No. 3,905,329. This defoamer resembles a modified hammer mill. Other types of defoamers are suitable, such as the one shown in the U.S. Pat. No. 3,420,450 to Bergholm.

In an installation of the type described, the defoamer should create as little back pressure as possible on the extrusion heads 44. It is desirable that the back pressure on the recycle line, measured at the location of slide valve 60, should be no higher and preferably somewhat lower than the normal operating pressure at this point when the extruder is delivering adhesive to a moving substrate material. If the back pressure exceeds this value, a surge of adhesive will be experienced when the slide valves shifts during a startup cycle. This surge of adhesive will cause an overspread condition along a short length of substrate passing beneath the extrusion head.

Reference to FIG. 3 shows another view of how the extrusion heads are suspended over the powered layup line. The power-driven conveyor line, generally indicated at 66, consists of a structural framework 80 containing rollers 82, 84, which may be driven rolls, and which support the conveyor belt 86. As shown in this illustration, two veneer sheets have already been assembled. The lower sheet 88 has already had adhesive applied and has been covered by another veneer sheet 90. The conveyor line is moving the veneer under the end-to-end extrusion heads 44, 44' which, in this case, are somewhat longitudinally displaced from each other for ease of mounting. Foamed adhesive 92 is being forced from the extrusion heads onto the top of the veneer sheet 90. The heads are supported by a structural framework 91.

Figure 7:
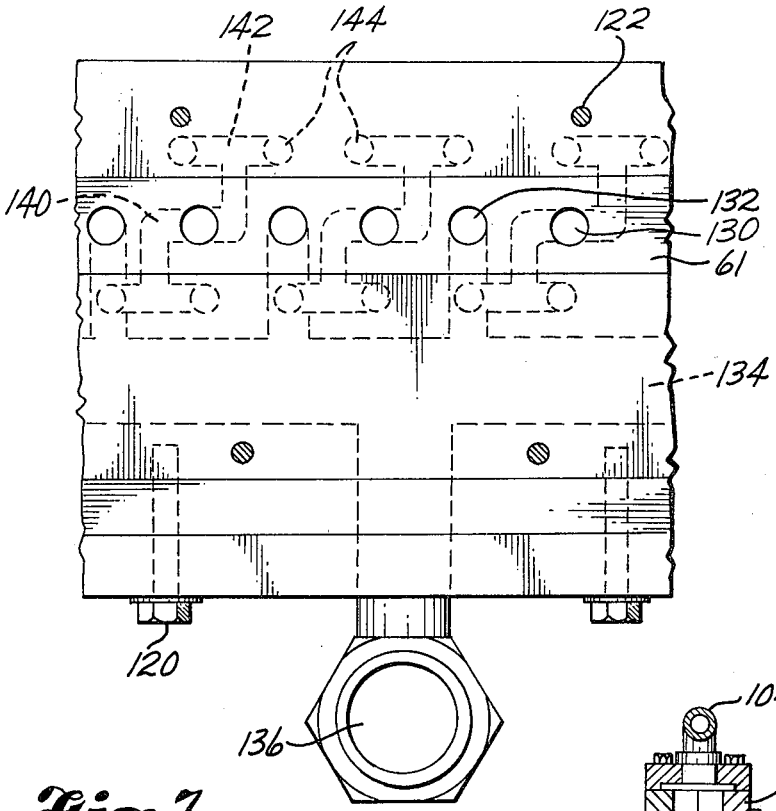
FIG. 7 is a fragmentary view along line 7—7 of FIG. 6 showing details of the portion in the extrusion head body immediately below the slide valve.
Figure 6:
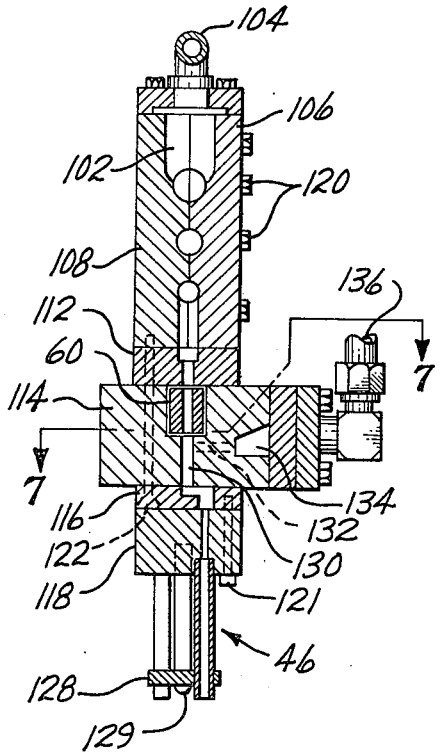
FIG. 6 is a vertical section of an extrusion head taken through line 6—6 of FIG. 4 and showing in particular the location of the slide valve.

Reference should now be made to FIGS. 4–7 in which the construction of a preferred form of extrusion head is shown in detail. The head, generally indicated at 44, comprises an upper body member 100 which contains internal porting and bifurcating channels 102 designed to bring a uniform flow of adhesive to each of the extrusion nozzles. Foamed adhesive is delivered to the head through a supply pipe 104. For ease of machining, the upper body is made into two halves 106, 108. These are joined to a middle body portion 112 which overlies another portion 114 which contains the slide valve. Beneath the slide valve, another portion 116 further bifurcates the adhesive stream. A nozzle mounting portion 118 is located at the bottom of the extrusion head and completes the assembly. The head is assembled by bolts of which those indicated at 120, 121, and 122 are representative, so that it can be readily disassembled for occasional thorough cleaning or repair. The slide valve 60 operates in a channel 61 located in body portion 114 (FIG. 7). A position sensor 126 notes the position of the slide valve so that if it should inadvertently jam during a start-up or shut-down, an alarm signal will be given.

A plurality of nozzles 46 depend from the nozzle block 118. These are held rigidly fixed in relationship to each other by a support plate 128 held to the mounting block by studs 129.

The slide valve channel 61 located in body portion 114 is ported so that the slide valve will deliver adhesive either to the nozzles through orifices 130 or to the recycle system through orifices 132. These latter orifices enter into a common channel 134 which empties into a recycle line 136. When the slide valve is in position to deliver adhesive to the veneer, it will be located so as to pass adhesive though ports 130 into the first bifurcation 140 then send it to the second bifurcation 142 and, ultimately, into extrusion nozzles 144. The channels 140 will normally be located within body portion 116, or in the lower part of body portion 114. Bifurcation 142 can be located within the top of the nozzle block 118 or in the lower portion of block 116, depending on the whims of the machinst.

Figure 8:
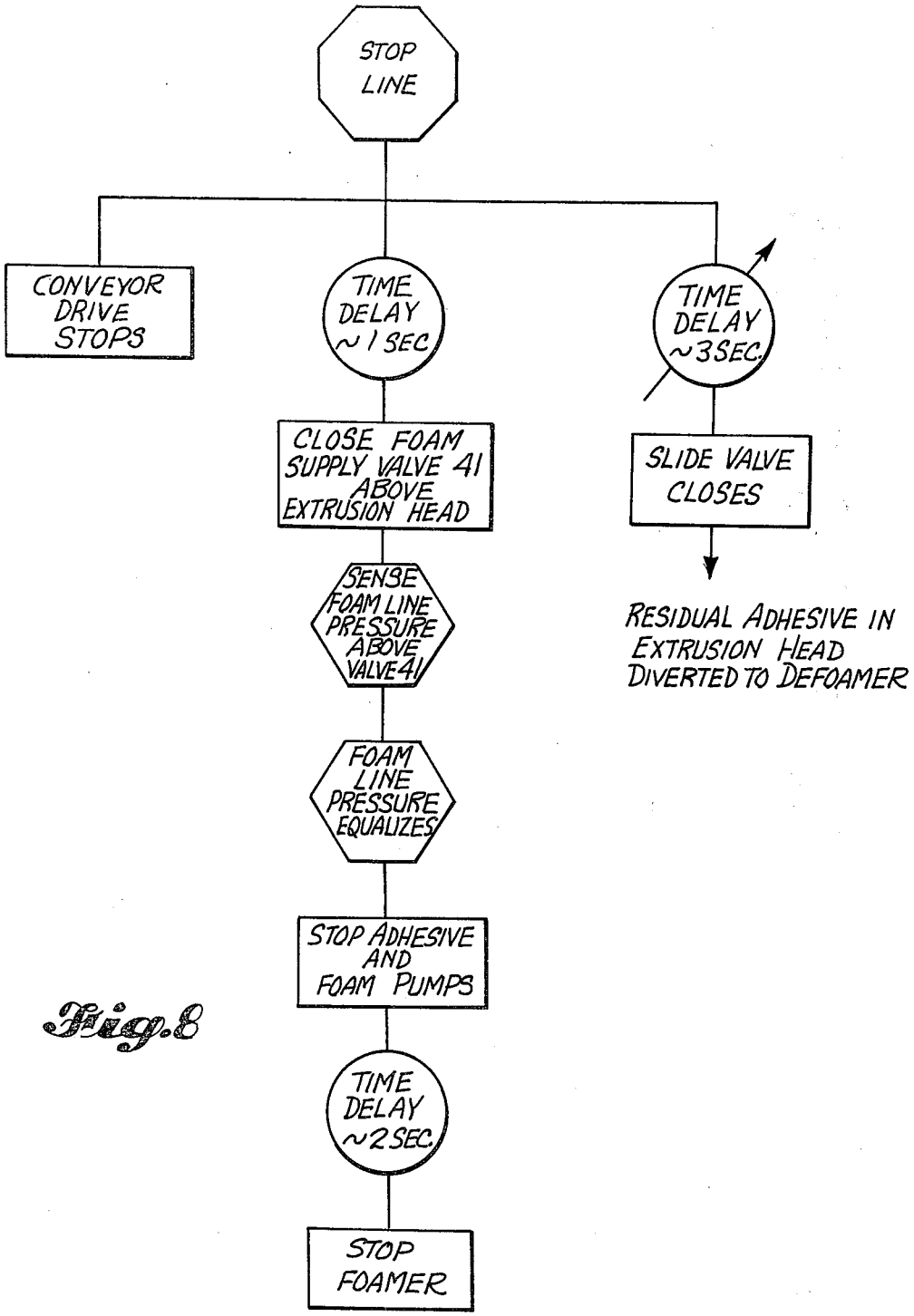
FIG. 8 is a diagrammatic representation of the process sequence during a line stoppage.

Reference to FIG. 8 will now describe in detail the series of events that occurs during a stoppage in the layup line conveying the veneers. The first thing that occurs when a signal is received to stop the line is to shut down the motor driving the line. It is important to the operation of the system that shut-downs and start-ups be consistent. Thus, if on one occasion the line coasts 150 cm after receipt of a stop signal, and on another occasion coasts only 50 cm, consistent glue spreads cannot be achieved during shut-downs. Normally, the line will be supplied with a positive brake system to ensure uniform stops. Other sequences are set in action upon receipt of a stop signal. The first, after a time delay of approximately one second, is the closure of valve 41 located adjacent to the extrusion head. This prevents further flow of foamed adhesive into the head. Sensor 42 at this location senses the pressure buildup. When the pressure at valve 41 has risen to about the normal operating pressure at the discharge of foam pump 38, a signal is sent which stops the adhesive metering pump and the foam pump. A second time delay is then activated which will shut down the foamer approximately two seconds later.

While the preceeding sequence is being carried out, one other is occurring in parallel. Upon the receipt of the stop signal, another time delay was actuated so that slide valve 60 within the extrusion head would be closed an instant before the conveyor line came to a complete stop. This time delay is normally adjustable by the operator. The precise time set will depend somewhat upon the speed of the particular conveyor line at the time of shut down. When the slide valve closes, any residual adhesive retained in the extrusion head between the slide valve and valve 41 is allowed to freely expand within the recycle line and into the defoamer. It should be noted that only a very small amount of adhesive needs to be recycled during shut-down conditions.

The reason that the pressure within the high pressure foam line is allowed to equalize during a shutdown is to minimize the time required to again achieve equilibrium conditions in the extrusion head during startups.

Figure 9:
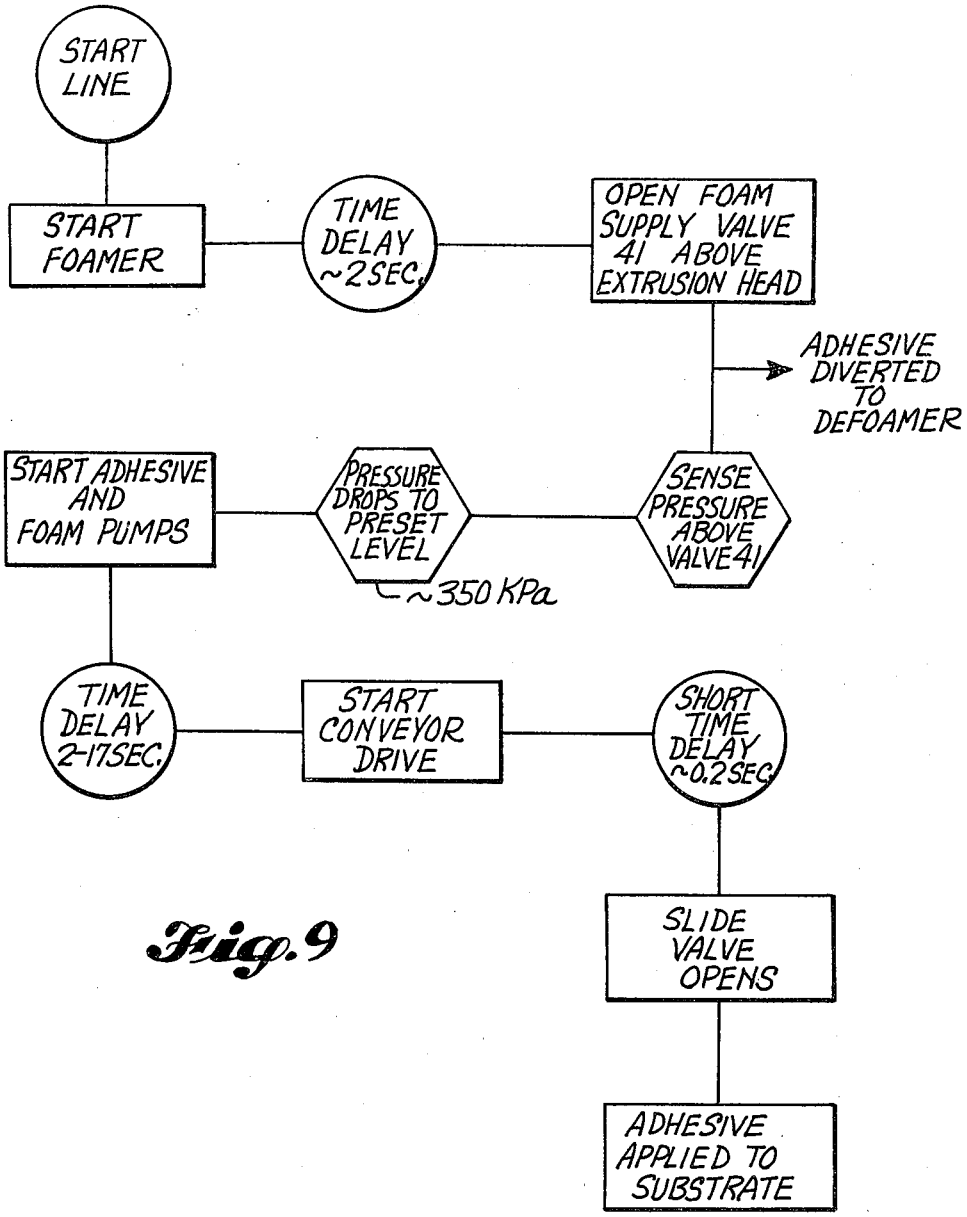
FIG. 9 is a diagrammatic repesentation of the process sequence during a lie start-up.

When a signal to start the line is recieved (FIG. 9), a first response is for the foamer to again start. After approximately a two second time delay, the first valve 41, located adjacent to the extrusion head, opens and the accumulated foam within the high pressure line is allowed to expand into the extrusion head. Initially, this adhesive is also diverted to the defoamer. Pressure sensor 42, located at valve 41, senses when the pressure within the foam line has dropped to preset level of approximately 350 kPa. When this condition is attained, sensor 42 signals the adhesive and foam pumps 30 and 38 to again start. This signal also initiates a variabe time delay which, when timed out, starts the conveyor drive system. A very short time later, another operator variable time delay times out in approximately 0.1 to 0.2 seconds, allowing slide valve 60 to open and adhesive to again applied to the substrate.

The variable time delay which controls the start of the conveyor drive is preferably controlled, as is the entire system, by a dedicated microcomputer or other programmable controller. The purpose of this time delay is to insure that adhesive of satisfsactory quality will be available in the extrusion head, above the slide valve, for application to the veneer. Since the foamed adhesive retained within the high-pressure foam line, as well as the small amount contained within the extrusion head, will deteriorate in quality over time is important that the system compensate for this on startup. This is the purpose of the variable time delay following the startup of the foam pumps. If the plywood assembly line has been shutdown for 60 seconds or less; this delay will time out in approximately 4 seconds. During this time, the foamed adhesive will be passed through the extrusion head and into the recycle line to the defoamer. If the line has been down for as long as ten minutes, a time delay of 14 seconds has been found adequate in which to restore foamed adhesive quality within the extrusion head. Again, foamed adhesive is recycled only for a very short period of time during the entire shutdown and startup sequence. This small amount of recycled adhesive thus has minimal effect on the overall quality of the adhesive within the hold tank.

Figure 10A:
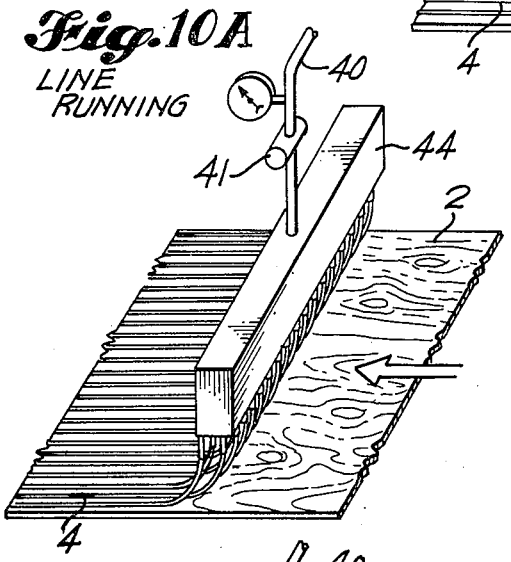
FIG. 10 shows perspective and side elevation views of the flow of adhesive from the extrusion head onto moving veneer.
Figure 10B:
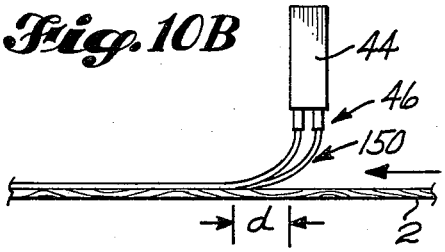
Figure 11A:
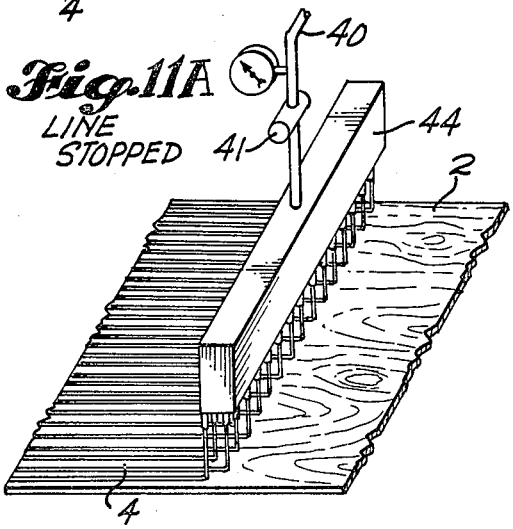
FIG. 11 shows perspective and side elevation views of the relationship between adhesive streams and veneer when the conveyor line is stopped.
Figure 11B:
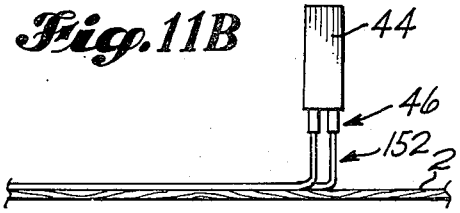

As was described earlier, the foamed adhesive should have a high internal consistency so that it will not freely drip from the extrusion nozzles. As an analogy, the foam somewhat resembles a very soft, well-cooked spaghetti strand in consistency. It should normally be of a nature that a strand of the foam can be held between two supports horizontally separated from 30 to 40 cm without breaking under its own weight. This quality in the foam is important in achieving uniform spreads during start and stop periods. FIG. 10 indicates the appearance of the foam as it flows from the nozzles onto the veneer during normal operating conditions. The foam strands 150 will be drawn from the nozzle for a distance d before they actually contact the veneer. This distance will depend somewhat on the line operating speed but will normally be approximately 5–10 cm. The distance between the bottom of the nozzles 46 and the top surface of veneer 2 will be approximately 10–15 cm. The condition during a period of line stoppage is shown in FIG. 11. As the veneer decelerates, the draw decreases until the point when the line has come to a complete stop and the slide valve is closed. Then the foam 152 will depend approximately straight down from the nozzles until it contacts the veneer. It is important to note that the foam will remain in this condition and will not simply drip from the nozzles during the periods of line stoppage. When the line is again started, this foam will be drawn from the nozzle until it ultimately retains a draw such as indicated in FIG. 10. Immediately after line startup, the slide valve will open and permit fresh adhesive to flow from the extruder heads. In this manner, the actual spread weight in terms of kilograms per square meter of adhesive is held remarkably uniform during periods of stoppage and starts. Adequate adjustment is provided through the two operator controlled variable time delays shown in FIGS. 8 and 9 to insure that a minimum of puddling or gaps occur.

As was noted earlier, the foamer and foam pumps are conventional equipment. The foamer used to supply foamed adhesive for a side-by-side pair of extrusion heads on a nominal 122 cm (4 ft) plywood layup line is a 20 cm (8 in) Oakes Continuous Automatic Mixer manufactured by Oakes Machine Corporation, Islip, L.I., New York. The phenolic resin adhesive was foamed with an air to resin ratio of approximately 5:1 to give a delivered foam with a specific gravity of about 0.2. The adhesive pump and the foam pump were conventional gear pumps having rubber covered rotors with a maximum delivery rate of 930 L/hr. The two pumps were identical in capacity and construction and were positively coupled so that the foam pump operated at 1.5 times the rotational speed of the adhesive pump. The plywood assembly line normally ran at a speed of 18-21.5 m/min. Adhesive spread rates varied between 0.10 and 0.15 kg/m$^2$. Thus, the system was required to deliver approximately 2.8 to 3 kg/min of foamed adhesive.

The two extrusion heads were each 0.625 m in width and each contained 64 extrusion nozzles 10 cm long and 3.2 mm in inside diameter.

In the system being described, a pressure of approximately 210 kPa has been found desirable in the high-pressure foam line at the location of the extrusion head. The output pressure of the foam pump is in the neighborhood of 700 kPa. The high-pressure foam line should thus be sized in length and diameter so that a pressure drop of approximately 500 kPa occurs as the foam traverses it. For the present system, a flexible hose 19 mm in diameter and 3.66 m in length has been found to supply these requirements.

Having thus described our best known mode of practicing the invention, it will be apparent to those skilled in the art that many modifications can be made in the apparatus and method without departing from the spirit of the invention. The scope of the invention is thus to be limited only as defined in the appended claims.

What is claimed is:

1. A process for applying a uniform amount of a foamed adhesive to a substrate normally moving at a uniform rate of speed but subject to stops and starts at irregular intervals which comprises:

a. extruding a predetermined amount of the foamed adhesive from an extrusion head onto the moving substrate;

b. sending a signal to stop the conveyor line moving the substrate, simultaneously closing a first valve to cut off the supply of foamed adhesive to the extrusion head, said valve being located in the foamed adhesive supply line in the proximity of the extrusion head so as to define a predetermined volume of foamed adhesive remaining under residual pressure in the head;

c. permitting the foamed adhesive remaining in the extrusion head to continue to flow onto the decelerating substrate from the action of the retained pressure so that it is applied at a decreasing rate as the residual pressure in the extrusion head drops; and d. at approximately the time when the substrate has decelerated to a complete stop, closing a second valve located at a point in the extrusion head system where the foamed adhesive is at essentially atmospheric pressure in order to stop any further flow of adhesive onto the substrate so that during the deceleration period the substrate receives an essentially uniform spread weight & foamed adhesive without overspreading or creating adhesive free gaps.

2. The process of claim 1 in which the second valve is a threeway valve and the adhesive is diverted into a recycle line when the valve is closed.

3. The process of claim 1 which further includes:

a. providing a positive displacement pump to supply a predetermined amount of unfoamed adhesive to a foaming device
b. further providing a foamer to introduce a gas into the adhesive, and
c. providing a second positive displacement pump to provide back pressure on the foamer and supply foam to the extrusion head at a predetermined rate.

4. The process of claim 3 in which the two pumps are mechanically coupled.

5. The process of claim 3 including:
a. sensing the pressure in the foamed adhesive supply line at the location of the first valve;
b. further sensing the pressure during normal operation at the delivery side of the foam supply pump upstream from the first valve;
c. shutting down the unfoamed adhesive supply and foam supply pumps when the pressure in the foamed adhesive line at the first valve has reached the normal pressure at the delivery side of the foam pump; and
d. maintaining the pressure in the foamed adhesive line until the system again is called on to deliver adhesive to the substrate.

6. The process of claim 5 in which the foamer is shut down after the unfoamed adhesive and form supply pumps are shut down.

7. The process of claim 3 in which the foam supply pump is gear pump.

8. The process of claim 3 in which both pumps are gear pumps.

9. The process of claim 2 in which the recycled adhesive is defoamed and recycled to a supply tank.

10. The process of claims 1, 2, 3, or 5 in which upon receipt of a signal to restart the substrate conveyor line a sequence is activated which comprises:
a. opening the first valve to permit a fresh supply of foamed adhesive to flow into the extrusion head;
b. bypassing the foamed adhesive into a recycle line at the location of the second valve for a time sufficient to establish predetermined foam quality and pressure drop across the extrusion head; then
c. starting the forward movement of the conveyor line moving the substrate; and
d. opening the second valve to permit adhesive to again flow onto the substrate.

11. The process of claim 1 in which the substrate is wood veneer.

12. The process of claim 10 in which the substrate is wood veneer.

13. The process of claim 1 in which the extrusion head has series of orifices which deposit beads of adhesive on the substrate.

14. The process of claim 10 in which the extrusion head has series of orifices which deposit beads of adhesive on the substrate.

15. The process of claim 13 in which the beads of adhesive foam have sufficient cohesive strength to retain their integrity and not drip from the nozzle when the substrate movement is stopped but remain as discrete strands depending from the orifices and lying on the substrate as essentially parallel lines.

16. The process of claim 14 in which the beads of adhesive foam have sufficient cohesive strength to retain their integrity and not drop from the nozzle when the substrate movement is stopped but remain as discrete strands depending from the orifices and lying on the substrate as essentially parallel lines.

17. The process of claim 15 in which the substrate is accelerated after a stop period and the adhesive flow is restarted so as to retain the lines of adhesive on the substrate in substantially parallel condition without forming puddles or breaks.

18. The process of claim 1 including extruding the adhesive from the extrusion head onto the substrate through a series of uniformly spaced nozzles.

19. The process of claim 18 which further includes dividing the foamed adhesive within the extrusion head in a series of bifurcating channels between the adhesive supply line and the nozzles in order to achieve essentially equal flow rates from each nozzle.

20. The process of claim 19 in which the sum of the cross-sectional areas of the channels downstream from each bifurcation is essentially equal to the cross-sectional area of the upstream channel at the point of bifurcation.

21. The process of claims 19 or 20 in which the distances to any nozzles downstream from a point of bifurcation are essentially equal.

22. The process of claim 2 in which the second valve is a slide valve.

23. The process of claim 10 in which the peak pressure in the recycle line, measured at the extrusion head, is essentially equal to or slightly below the normal operating pressure at the second valve at the time the second valve is opened to permit adhesive to flow into the substrate.

* * * * *

UNITED STATES PATENT AND TRADEMARK OFFICE

CERTIFICATE OF CORRECTION

PATENT NO. : 4,420,510

DATED : December 13, 1983

INVENTOR(S) : Arden L. Kunkel and Darrell E. Pierson

It is certified that error appears in the above—identified patent and that said Letters Patent is hereby corrected as shown below:

In column 5, line 7, "lie" should read --line--;

In column 6, line 25, "ine" should read --line--;

In column 6, line 32, after "use", insert --two--;

In column 8, line 61, "variabe" should read --variable--;

In column 10, line 41, after "substrate", insert --and--;

In column 10, line 62, "&" should read --of--;

In column 11, line 27, "form" should read --foam--;

In column 11, line 43, after "establish", insert --a--;

In column 12, line 4, after "has", insert --a--;

In column 12, line 7, after "has", insert --a--;

Signed and Sealed this

Tenth Day of July 1984

[SEAL]

*Attest:*

GERALD J. MOSSINGHOFF

*Attesting Officer*

*Commissioner of Patents and Trademarks*